US006109353A

United States Patent [19]

Edwards et al.

[11] Patent Number: 6,109,353

[45] Date of Patent: Aug. 29, 2000

[54] SINGLE BORE RISER SYSTEM

[75] Inventors: Jeffrey Charles Edwards, Aberdeen; Michael Graham Morgan, Banff, both of United Kingdom

[73] Assignee: Expro North Sea Limited, Dyce, United Kingdom

[21] Appl. No.: 09/043,457

[22] PCT Filed: Sep. 13, 1996

[86] PCT No.: PCT/GB96/02256

§ 371 Date: Aug. 11, 1998

§ 102(e) Date: Sep. 11, 1998

[87] PCT Pub. No.: WO97/11253

PCT Pub. Date: Mar. 27, 1997

[30] Foreign Application Priority Data

Sep. 20, 1995 [GB] United Kingdom ..... 9519202

[51] Int. Cl.[7] ..... E21B 17/01

[52] U.S. Cl. ..... 166/367; 166/344; 166/360; 166/368

[58] Field of Search ..... 166/313, 366, 166/381, 117.5, 117.6, 97.5, 89.2, 242.3, 367, 368; 175/5, 7–9

[56] References Cited

U.S. PATENT DOCUMENTS

| | | | |
|---|---|---|---|
| 3,189,099 | 6/1965 | Otteman et al. | 166/340 X |
| 3,376,923 | 4/1968 | Bullard | 166/340 |
| 3,536,344 | 10/1970 | Nelson | 166/340 X |
| 3,710,859 | 1/1973 | Hanes et al. | 166/347 X |
| 4,126,183 | 11/1978 | Walker | 166/338 |
| 4,331,203 | 5/1982 | Kiefer | 166/360 X |
| 4,585,369 | 4/1986 | Manesse et al. | 166/340 X |
| 4,848,472 | 7/1989 | Hopper | 166/344 |
| 5,161,620 | 11/1992 | Ritter | 166/359 |
| 5,377,762 | 1/1995 | Turner | 166/339 |
| 5,535,826 | 7/1996 | Brown et al. | 166/368 X |
| 5,544,707 | 8/1996 | Hopper et al. | 166/368 X |
| 5,873,415 | 6/1965 | Edwards | 166/368 X |
| 5,884,706 | 3/1999 | Edwards | 166/368 X |

*Primary Examiner*—Dennis L. Taylor
*Attorney, Agent, or Firm*—Pennie & Edmonds LLP

[57] ABSTRACT

A single bore riser system is disclosed which is based on a dual bore completion tree. An eccentric offset sub is coupled to the top of the tree and which can be sealed by BOP pipe rams. The completion tree has a main bore and an auxiliary bore with ball valves located in the respective bores. A remotely actuatable annulus plug is located in the bottom of the annulus bore and is moveable between a first position allowing fluid flow through the annulus bore and a second position sealing the annulus bore to provide control of various operations. Embodiments of the invention are described.

9 Claims, 1 Drawing Sheet

74
70
72
76
68
66
69
64
62
20
28
60

13
13
50
52
36
30
40
22
34
32
44
38
42
54
48
46
20
18
26
24
28
17

12
10
14
16
17

SINGLE BORE RISER SYSTEM

The present invention relates to a riser system particularly, but not exclusively, for use with sub-sea intervention work.

Existing riser systems for use in interventions are dual bore: there is a main bore and an annulus bore. The main bore allows full access to the well and is typically 5" diameter and the annulus bore, which is 2" diameter, allows control of the annulus pressure so that pumping or stimulation operations can be performed and fluid returns monitored and controlled at surface. The annulus bore also allows pressure testing of the annulus and also pressure testing of a tubing hanger located in, for example, a casing lined borehole and from which tubing such as a liner may be hung.

Existing dual bore riser systems typically involve two sets of tubing; a 5" tubing and a 2" tubing which are coupled together at surface to a downhole tool, such as a tubing hanger or tubing hanger running tool, or a 5"×2" completion tree, such as disclosed in applicant's U.S. Pat. No. 5,873,415. In addition, the dual bore riser may use a main bore consisting of high quality pipe and an annulus bore made of coiled tubing as disclosed in applicant's U.S. Pat. No. 5,960,885.

With a dual bore riser system it is necessary to run both the main bore tubing and the annulus tubing at the same time and to clamp the tubes together at regular spaced intervals along their lengths which is relatively time consuming.

Furthermore, after a pressure test of the tubing hanger is carried out it is necessary to run separate 5" and 2" wireline plugs. This further adds to the time taken to run which results in increased expense.

An object of the present invention is to provide an improved riser system which obviates or mitigates at least of the aforementioned disadvantages.

A further object of the present invention is to provide a single bore riser system in which a single umbilical can be used which allows pressure testing to be carried out and also wireline plugs to be set without the need to run a separate dual bore riser.

This is achieved by using a dual bore completion tree and coupling an eccentric sub to the top of the tree which may be sealed by BOP pipe rams and also by storing a wireline plug in the annulus bore which has a by-pass and which allows communication to provide annulus control and which may be remotely actuated to plug the annulus bore.

The principal advantage of this arrangement is that it provides a single bore riser system which allows the running of a single tubing offering major savings in terms of time and cost. A further advantage is that the modified completion tool can be used to retrieve wireline plugs from the main bore and the annulus bore and also allows the testing of the annulus and tubing hanger.

According to a first aspect of the present invention there is provided a single bore riser system comprising:

a single riser, an eccentric or offset sub coupled to the bottom of the riser, a dual bore completion tree coupled to the bottom of the offset sub whereby the offset sub is coupled to the main bore of the sub-sea test tree which is off centre from the main axis of the completion subsea tree, the completion sub-sea tree having a main throughbore and an annulus through-bore, at least one valve element located in the main bore and at least one valve element located in the annulus bore, said valve elements being operable to move between an open and a closed position whereby when the valves are in an open position there is communication through the main bore and through said annulus bore and when said valves are in the closed position, there is no communication through the main bore or said annulus bore, a wireline plug located in the annulus bore downstream of said valve element, said wireline plug being moveable between a first position whereby communication is permitted past said plug and through said annulus and a second position whereby said plug is moveable into the tubing hanger to seal said annulus.

Preferably, there are two valves in said main bore, said valves being connected in series. Conveniently, said valves are ball valves. Alternatively, said valves may be roller valves, gate or flapper valves.

Preferably also, the valve in the annulus bore is a ball valve. Conveniently, said ball valves are apertured ball valves which are moveable rotationally as well as axially within said bores upon actuation of hydraulic pressure so that the valves may be moved between and open and a closed position.

Preferably also, said wireline plug is coupled to a hydraulically actuated sleeve also disposed in said annulus bore downstream of said annulus valve, said annulus sleeve being hydraulically actuatable so as to move the wireline plug between a first position whereby fluid through said annulus bore may by-pass said plug and travel through said annulus bore and a second position whereby said wireline plug seals the wireline bore in the tubing hanger thereby preventing communication through the annulus.

According to a further aspect of the present invention, there is provided a method of running a uni-bore riser system for a well test intervention system, said method comprising the steps of coupling an offset sub to a single umbilical, coupling a dual bore completion tree to the offset sub, providing an actuatable wireline plug in said annulus bore, coupling the completion tree to the tubing hanger within the wellhead and actuating the wireline plug to move between a first position whereby annulus fluid is permitted to by-pass the plug and a second position whereby the wireline plug is sealed within the tubing hanger.

These and other aspects of the invention will become apparent from the following description when taken in combination with the accompanying drawings in which.

Figures 1, 2, 3:
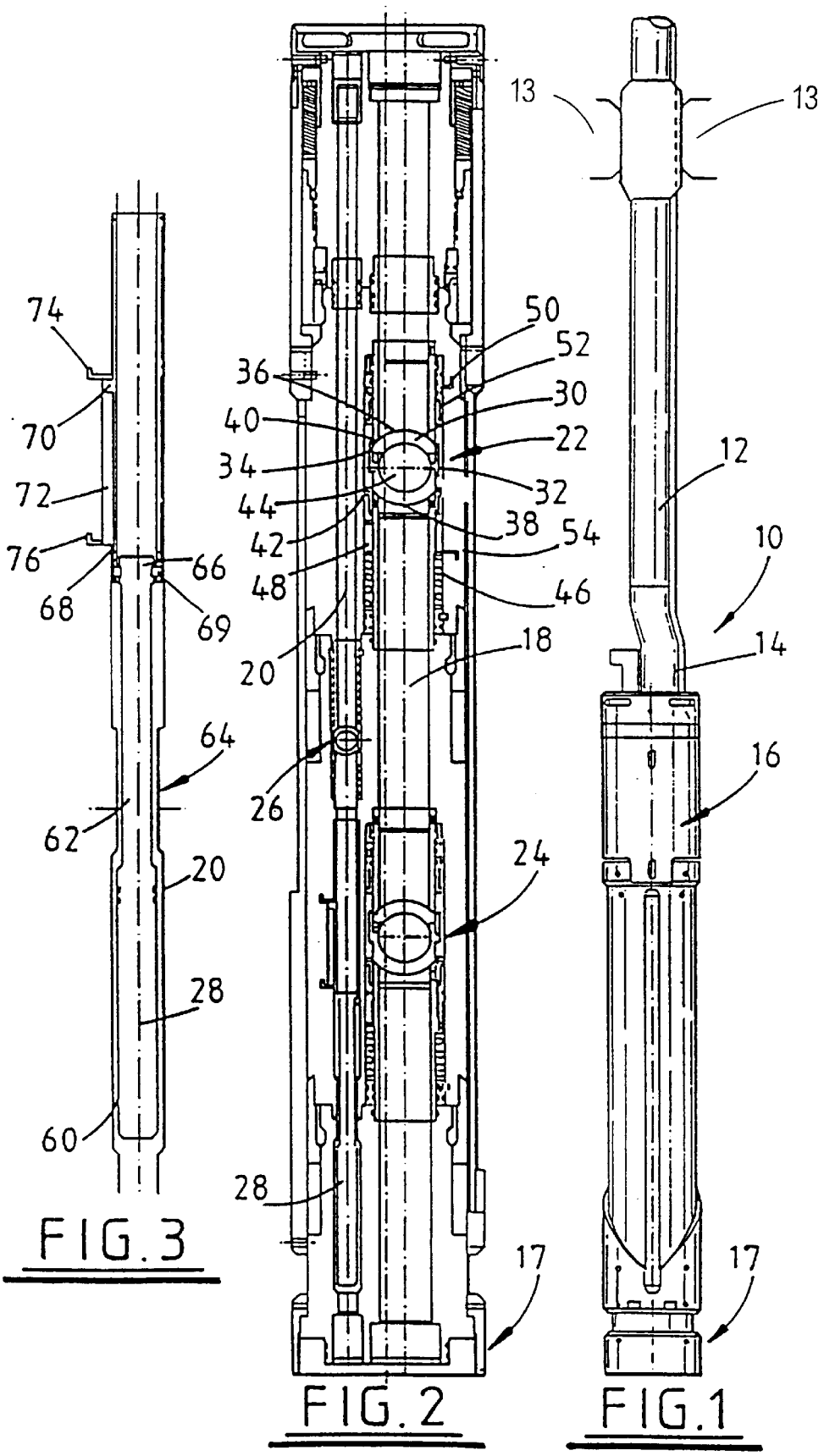
FIG. 1 is a longitudinal view of a single bore riser system in accordance with an embodiment of the invention.
FIG. 2 is an enlarged, and longitudinal sectional view, of the completion tree shown in FIG. 1.
FIG. 3 is a view of part of the apparatus of FIG. 2 drawn to a larger scale and showing the annulus plug located in the annulus bore.

Reference is first made to FIG. 1 of the drawings which depicts a single bore intervention system generally indicated by reference numeral 10. The intervention system consists of a single bore riser or umbilical 12, an offset sub 14 and a 5"×2" completion subsea tree 16. The riser 12 is sealed by pipe rams 13 of a Blow Out Preventer (BOP) of a BOP stack on the wellhead. The completion tree is adapted to be coupled to a tubing hanger (not shown) by a latch 17 at the lower end of the subsea tree 16. The offset sub is located between the riser 12 and the completion tree 16. In this regard, reference is made to applicant's U.S. Pat. No. 5,873,415 which discloses the 5"×2– sub-sea completion tree in detail. It will be appreciated that the offset sub 14 is an eccentric sub, that is, it is located between an off-centre aperture (not shown) at the top of the completion tree and the riser or umbilical 12, which is centralised or co-axial to the main axis of the completion subsea tree 16. The eccentric sub allows the 5"×2" completion tree 16 to be run on the end of single bore riser tubing.

The completion tree 16 is substantially the same as that disclosed in the aforementioned patent application. Referring now to FIG. 2 , it will be seen that the completion tree has a main 5" bore generally indicated by reference numeral 18 and an auxiliary annulus 2" bore 20. Two identical ball valves 22 and 24 are located in series within the main bore 18. These ball valves are of the type disclosed in the applicant s U.S. Pat. No. 5,484,022. Similarly, a smaller ball valve 26, which is of the same type as valves 22, 24, is located in the annulus bore 20. Also disposed within the annulus 20 is an annulus plug generally indicated by reference numeral 28. The annulus plug 28, as will be described in detail later, is moveable between an out-of-use position whereby annulus fluid is allowed to flow through the annulus and an in-use position whereby the plug 28 is used to seal the annulus and, in particular, seals the annulus bore 20 in the tubing hanger.

Reference is now made to FIG. 2 of the drawings which is a longitudinal sectional view, drawn to a larger scale, of the completion tree 16 shown in FIG. 1. In this case, it will be seen that the ball valve 22 consists of a ball element 30 which has spigots 32 journaled in ball trunnions 34 which are, in fact, slots. As shown, the ball has upper and lower spherical surfaces 36 and 38 which are shown engaged against respective upper and lower valve seals 40 and 42. The ball element 30 has a through aperture 44 which is the same diameter as the main bore 18.

In the position shown in FIG. 2 the ball valves 22, 24 are shown in the closed position. This is because a lower coil spring 46 acts on an annulus piston 48 which, in turn, acts on a ball cage assembly to force the ball to be rotated and moved axially to the position shown. In order to open the valve, hydraulic pressure is applied via hydraulic line 50, one above the valve 22 which acts on annulus piston 52 and forces the piston 52 downward against the force of the spring and, as the spigots 32 move down, the oblique slots, which are described in U.S. Pat. No. 5,484,022, cause the ball valve element to be rotated through 90° so that the aperture is aligned with the bore 18 and thus the valve is opened. In order to close the valve, hydraulic pressure is applied via line 54 which has an outlet between the annulus piston 48 and spring 46 and this provides a force against the piston 48 to assist the force of the spring 46 in moving the piston upwards, and thus rotating the valve from the open position to the closed position as shown.

It will be appreciated that the other valves 24, 26 are configured to operate in the same way.

Disposed in the lower end of the annulus bore is the annulus plug 28. It will be seen that the annulus plug consists of a lower part 60 and an upper smaller diameter part 62. The annulus bore 20 has a narrower throat 64 in which the narrower bore 60 is located. At the top of the narrower bore 60 the annulus plug 28 has a larger diameter part 66 which is coupled to a cylindrical sleeve 68 by dogs 69. The cylindrical sleeve has a radial land 70 which projects from the sleeve into a longitudinal slot 72. The upper and lower parts of the slot 72 are connected to hydraulic lines 74 and 76. By applying hydraulic pressure to the upper 74 or lower line 76, the sleeve 68 and consequently the annulus plug can be moved upwards or downwards within the annulus bore 20. In the position shown in FIGS. 2 and 3, the annulus plug and sleeve are located in the upper position in which an annular gap is disposed between the exterior surface of the annulus plug and the interior surface of the bore 20. This means that when the ball valve 20 is opened, annulus fluid can flow through the annulus bore 20 to provide annulus communication allowing various operations to be conducted by opening and closing the annulus valve 26. After operations are complete, the annulus plug is actuated by pressurising hydraulic line 74 which forces the sleeve and annulus plug 28 downwards to seal the annulus bore in the tubing hanger annulus. A separate wireline plug is run through the single bore umbilical and main bore of the completion tree. Therefore, it will be appreciated that with the hereinbefore described arrangement it is not necessary to run a dual bore riser to set the wireline plugs, thus minimising expense and rig time.

The completion package 10 may then be disconnected from the tubing hanger and withdrawn through the BOP stack. A xmas tree can be installed on the wellhead and the wireline plugs removed either with the same intervention package by relatching the plugs or using a dual bore riser.

With regard to relatching the plugs, in a further embodiment the hydraulic plug setting and retrieval system are situated in the Lower Marine Riser Package (LMRP). This allows the annulus isolation plug to be retrieved after installation and testing of the production tree. The operating mechanism of the system is identical to that which is deployed in the dual bore tree with the exception of the requirement for the linear travel of the operating mechanism to be lengthened to enable the setting mechanism and plug to be retrieved completely into the LMRP and not obstruct the valves of the production tree. Annular pressure communication is achieved by the crossover system of the conventional tree.

This system provides the end user with significant cost reduction in terms of reduced capital expenditure and improved capacity costs by the reduction of time required to run the equipment.

It will be appreciated that various modifications may be made to the embodiment hereinbefore described without departing from the scope of the invention. In particular, it will be appreciated that the annulus plug may be actuated via means other than hydraulic means, for example electromagnetic means. In the embodiment shown, the annulus plug is coupled to the sleeve via locking dogs so that the annulus plug moves simultaneously with the sleeve. It will also be appreciated that the annulus plug may be "fired" in response to hydraulic pressure so as to seal into the tubing hanger annulus bore and thus separate from the actuating mechanism whereby the completion tree may be removed from the tubing hanger leaving the annulus plug, and any wireline plug, which is run in the tubing hanger. Similarly, in such an arrangement if the completion tree is again run through a tree, an inner sleeve within the annulus bore may be set to engage with the annulus plug and thus retrieve the annulus plug from the annulus bore, thereby allowing annulus communication again. In such a case, only a single wireline plug would be required to be retrieved via the main bore. Although the eccentric sub is shown external to the completion tree the main bore at the upper end of the tree may be manufactured so that the aperture or bore exit at the top of the tree is centred, there being a smooth transition, like the eccentric sub, between the exit and the off-centre main bore. It will also be understood that the invention can be used with various sizes of main and annulus bore diameters and is not limited to 5"×2" plugs.

It will be appreciated that the principal advantage of the present invention is that it allows a uni-bore or single bore riser to be run for well test, extended well test and setting plugs, thus greatly minimising time and expense. It also requires less equipment in setting up. It facilitates annulus communication and allows a pressure check to be conducted via choke and kill lines and the annulus bore and allows various sizes of plugs, for example 5" and 2" plugs, to be set using a single bore riser.

What is claimed is:

1. A single bore riser system comprising:

a single riser;

an eccentric or offset sub coupled to the bottom of the riser, and a dual bore completion subsea tree coupled to the bottom of the offset sub and having a main through-bore and an annulus through-bore, whereby the offset sub is coupled to the main bore of the completion sub-sea tree, which main bore is off centre from main axis of the completion sub-sea tree;

at least one valve element located in the main bore and at least one valve element located in the annulus bore, said valve elements being operable to move between an open and a closed position, such that when the valves are in the open position, there is communication through the main bore and through said annulus bore and when said valves are in the closed position, there is no communication through the main bore or said annulus bore;

a wireline plug located in the annulus bore distal from said offset sub, spaced from said annulus bore valve element, said wireline plug being moveable between a first position whereby, when said annulus bore valve element is in the open position, fluid communication is permitted past said plug, through a gap defined between an exterior surface of the plug and an interior surface of the annulus bore, and through said annulus bore, and a second position whereby said plug seals said annulus bore to prevent fluid communication through said gap and said annulus bore.

2. A system as claimed in claim 1 wherein there are two valves in said main bore, said valves being connected in series.

3. A system as claimed in claim 2 wherein said valves are ball valves.

4. A system as claimed in claim 1 wherein the valve in the annulus bore is a ball valve.

5. A system as claimed in claim 4 wherein said ball valve is an apertured ball valve which is moveable rotationally as well as axially within said bore upon actuation of hydraulic pressure so that the valve is moved between an open and a closed position.

6. A system as claimed in claim 1 wherein said wireline plug is coupled to a hydraulically actuated sleeve also disposed in said annulus bore downstream of said annulus valve, said annulus sleeve being hydraulically actuatable so as to move the wireline plug between the first positions whereby fluid passing through said annulus bore by-passes said plug and travels through said annulus bore and the second position, whereby said wireline plug seals in the annulus bore, thereby preventing communication through the annulus bore.

7. A single bore riser system comprising;

a dual bore completion subsea tree;

an eccentric sub coupled to the top of the tree and adapted to be sealed by BOP pipe rams;

the dual bore completion subsea tree having a main bore and an annulus bore with at least one valve element located in respective bores;

a moveable wireline plug disposed in the annulus bore and which is moveable between a first position, whereby fluid communication is permitted through a gap defined between an exterior surface of the plug and an interior surface of the annulus bore, and through said annulus bore and a second position, whereby said plug seals said annulus bore, to prevent fluid communication through said gap and said annulus bore to provide annulus control.

8. A single bore riser system comprising a dual bore completion subsea tree having a main bore and an annulus bore, an eccentric sub coupled to the top of the completion subsea tree, and moveable plug means disposed in said annulus bore which plug means is moveable between a first position whereby fluid communication is permitted through a gap defined between an exterior surface of the plug and an interior surface of the annulus bore, and through said annulus bore, and a second position, whereby said plug seals said annulus bore to prevent fluid communication through said gap and said annulus bore, to provide annulus control.

9. A method of running a uni-bore riser system for a well test intervention system, said well test intervention system comprising:

a single riser, an offset or eccentric sub and a dual bore completion subsea tree coupled to the offset sub, said subsea tree having a main bore offset from a main axis of the completion subsea tree and an annulus bore, said complete subsea tree having at least one valve element disposed in the main bore, at least one valve element disposed in the annulus bore and a moveable wireline plus located in the annulus bore spaced from said annulus bore valve element, said method comprising the steps of:

coupling the offset sub to the bottom of the riser and to the dual bore completion subsea tree, such that the offset sub is coupled to the main bore of the completion subsea tree; and moving the wireline plug within the annulus bore to control the flow through said annulus bore to provide annulus communication.

* * * * *